US012104262B2

(12) United States Patent
Crettenand et al.

(10) Patent No.: US 12,104,262 B2
(45) Date of Patent: Oct. 1, 2024

(54) ELECTROCHEMICAL REACTOR AND ITS CLEANING OR REGENERATION

(71) Applicant: Sedo Engineering SA, Riddes (CH)

(72) Inventors: David Crettenand, Riddes (CH); Grégoire Chappot, Savièse (CH); Ludovic Chappot, Charrat (CH); Herbert Gübeli, Goldingen (CH)

(73) Assignee: Sedo Engineering SA, Riddes (CH)

( * ) Notice: Subject to any disclaimer, the term of this patent is extended or adjusted under 35 U.S.C. 154(b) by 682 days.

(21) Appl. No.: 17/296,709

(22) PCT Filed: Nov. 29, 2019

(86) PCT No.: PCT/EP2019/083163
§ 371 (c)(1),
(2) Date: May 25, 2021

(87) PCT Pub. No.: WO2020/109595
PCT Pub. Date: Jun. 4, 2020

(65) Prior Publication Data

US 2022/0056595 A1 Feb. 24, 2022

(30) Foreign Application Priority Data

Nov. 30, 2018 (CH) ..... 01478/18
Nov. 30, 2018 (CH) ..... 01479/18

(51) Int. Cl.

| | |
|---|---|
| ***C25B 3/25*** | (2021.01) |
| ***C25B 9/19*** | (2021.01) |
| ***C25B 9/40*** | (2021.01) |
| ***C25B 15/00*** | (2006.01) |
| ***C25B 15/02*** | (2021.01) |
| ***C25B 15/08*** | (2006.01) |

(52) U.S. Cl.
CPC ..... *C25B 3/25* (2021.01); *C25B 9/19* (2021.01); *C25B 9/40* (2021.01); *C25B 15/00* (2013.01); *C25B 15/02* (2013.01); *C25B 15/085* (2021.01)

(58) Field of Classification Search
CPC .... C25B 9/40; C25B 3/25; C25B 9/19; C25B 15/00; C25B 15/02; C25B 15/085
See application file for complete search history.

(56) References Cited

U.S. PATENT DOCUMENTS 3,701,719 A 10/1972 Educ et al.
3,966,571 A 6/1976 Gagnon et al.
(Continued)

FOREIGN PATENT DOCUMENTS

CN 103255642 A 7/2015
CN 105603453 A 5/2016
(Continued)

OTHER PUBLICATIONS

Roessler et al., "Electrochemical reduction of indigo in fixed and fluidized beds of graphite granules", Journal of Applied Electrochemistry 33:901-908, 2003.
(Continued)

*Primary Examiner* — Ciel P Contreras
(74) *Attorney, Agent, or Firm* — Renner, Otto, Boisselle & Sklar, LLP

(57) ABSTRACT

An electrochemical reactor suitable for reducing dye to leucodye, comprises at least four electrolytic cells, wherein the electrolytic cells are provided in the form of at least two stacks of at least two electrolytic cells each such that one stack at a time can be separated for cathode or anode regeneration during suspension preparation.

13 Claims, 8 Drawing Sheets

(56) References Cited

U.S. PATENT DOCUMENTS

| | | | |
|---|---|---|---|
| 5,244,549 | A | 9/1993 | Bechtold |
| 5,586,992 | A | 12/1996 | Schnitzer et al. |
| 5,922,087 | A | 7/1999 | Nishioka et al. |
| 6,627,063 | B1 | 9/2003 | Marte et al. |
| 2003/0098246 | A1 | 5/2003 | Merk et al. |
| 2004/0069653 | A1 | 4/2004 | Merk et al. |
| 2005/0121336 | A1 | 6/2005 | Marte et al. |
| 2009/0308757 | A1 | 12/2009 | Crettenand |
| 2015/0298998 | A1 | 10/2015 | Legzdins |
| 2018/0023202 | A1 | 1/2018 | Krause et al. |

FOREIGN PATENT DOCUMENTS

| | | | |
|---|---|---|---|
| DE | 102015202117 | | 8/2016 |
| EP | 1297200 | | 1/2007 |
| EP | 0760805 | | 1/2008 |
| GB | 1239983 | | 7/1971 |
| JP | H10 130876 | | 5/1998 |
| WO | 1990/015182 | | 12/1990 |
| WO | 1994/023114 | | 10/1994 |
| WO | 2000/031334 | | 6/2000 |
| WO | 2001/046497 | | 6/2001 |
| WO | 2007/147283 | | 12/2007 |
| WO | 2020/109577 | A1 | 6/2020 |
| WO | 2020/109583 | A1 | 6/2020 |

OTHER PUBLICATIONS

Written Opinion and International Search Report for corresponding application PCT/EP2019/083163, mailed Mar. 4, 2020.

Bechtold, et al., "Reduction of Dispersed Indigo Dye by Indirect Electrolysis", VCH Verlagsgesellschaft mbH. W-6940 Weinheim, 1992.

Roessler et al., "Electrocatalytic Hydrogenation of Indigo: Process Optimization and Scale-up in a Flow Cell", Journal of the Electrochemical Society, vol. 150, No. 1, Nov. 2002.

ELECTROCHEMICAL REACTOR AND ITS CLEANING OR REGENERATION

This application is a national phase of International Application No. PCT/EP2019/083163 filed Nov. 29, 2019 and published in the English language, which claims priority to Switzerland Application No. 01478/18 filed on Nov. 30, 2018 and Switzerland Application No. 01479/18 filed on Nov. 30, 2018, the entire disclosures of which are hereby incorporated by reference.

TECHNICAL FIELD

The present invention regards the field of electrochemical reactors that are e.g. suitable for use in dyeing with vat dyes and sulphur dyes, such as in indigo dyeing, and in particular the cleaning or regeneration, respectively, of the electrodes.

BACKGROUND ART

The use of vat and sulfur dyes for printing and colouring of textile fibres is long known. Such dyes have to undergo reduction and oxidation processes. For many years such processes have been associated with the application of over-stoichiometric amounts of reducing agent relative to the amount of dye to be reduced. The reduction of the vat dyes conventionally takes place in alkaline (pH>9), aqueous solutions with sodium dithionite (hydrosulfite), reduction agents derived therefrom (e.g. RONGALIT C, BASF) or thiourea dioxide in conjunction with wetting agents and complexing agents.

The reduction agents suitable for reduction of vat dyes should have a redox potential, under the conditions necessary for the vatting of the dyes, of −400 mV to −1000 mV. Both the application of hydrosulfite and of thiourea dioxide lead to a high sulfite or sulfate loading of the effluent. These salt loads are on the one hand toxic, and on the other hand corrosive. Another problem of the sulfate load in the effluent arising from the sulfite is the toxic hydrogen sulfide formation in the sewer system pipes, caused by anaerobic organisms.

Applying ultrasound reactors in conjunction with the conventional reduction agents lowered the reduction-agent consumption to stoichiometric proportions. In addition, the hydrosulfite can be replaced with endiols.

Electrochemical methods as disclosed in WO 90/15182, WO 94/23114 and WO 00/31334 have the disadvantage that they need very large electrode surfaces, have low efficiency, and/or have a low economicity and/or need the use of mediator systems.

Direct electrochemical reduction of indigo via the indigo radical has been proposed as an alternative to mediated electrochemical reduction. The radical anion is formed by a comproportionation reaction between the dye and the leucodye. All experimental data for the direct electrochemical reduction of vat dyes suggest a diffusion-controlled reduction of the intermediate radical anion as the rate-limiting step. Because this limiting rate is critically depending on the thickness of the diffusion layer at the electrode surface, an increase of the catholyte flow is assumed to significantly enhance the reduction rate. The low stability of the radical form of indigo and the necessity of high flow to achieve a good efficiency makes it unlikely that the process will be industrialised.

Electrocatalytic hydrogenation, as described in WO 01/46497 is an alternative to the above described radical reaction. This process involves electrochemical hydrogenation in which adsorbed hydrogen, produced in situ by electrolysis of water, reacts with adsorbed organic substrates (i.e. vat dye) at the electrode surface. The hydrogenation step is in competition with hydrogen evolution reaction and the efficiency of the electrocatalytic hydrogenation is determined by this competition. For indigo it was tried to optimise the conditions and a scale-up in indigo concentration up to 10 g/1 with Raney nickel as electrode material was achieved. Unfortunately, using the optimised conditions, only a low current efficiency of 12.7% could be reached at 95% conversion, requiring a huge electrode surface of more than several hundreds square meters to attain an industrially feasible reduction rate for stock solutions. For improving this method the so-called precoat-layer-cell has been developed. The cathode is formed by a support of an electrically conductive material (i.e. filter fabrics) and a cathodically polarized layer (i.e. Raney nickel) formed on the filter in situ by precoat filtration. The severe drawback of this technique seems to be the big pressure drop built up during the filtration process and the persistent danger of blocking the reactor. As an alternative noble metal particles supported on graphite granules have also been investigated as electrode material in a fixed bed and a fluidised bed reactor. The pressure drop over the granular material was much lower than in case of fine Raney nickel powder and efficiency was quite good. However, noble metals are very expensive and the long-time behaviour of the catalyst was poor.

In 2003, it has been shown that graphite granules can act as electrode material for the direct electrochemical reduction of indigo in aqueous suspension. Optimised conditions were sought and a scale-up in indigo concentration to 10 g/1 was achieved (Roessler A, Crettenand D, Dossenbach O, Rys P. J Appl Electrochem, 33:901-908, 2003). Due to the high hydrogen overvoltage on graphite under the applied conditions, no chemisorption or only very weak chemisorption of hydrogen was possible suggesting a normal electron transfer as the relevant process for the reduction of indigo. Unfortunately, at the beginning the reduction rates were rather low. Due to acceleration work, however, for indigo the process could be improved until it competed with the mediator technique from an economic point of view.

GB 1239983 discloses an electrochemical process in which a bed of electrically conductive discrete particles is flown through by an electrolyte fluid. The fluid flow is chosen such that is always imparts movement to the particles. The particles are limited in their upward movement by a particle-impermeable barrier positioned above the particle bed. The particle movement is important since the aim is that the volume occupied by the moving particles is less than the natural volume which the particles would occupy as a fluidised bed in the absence of the impermeable barrier. A problem with this approach is the fact that the conductivity of the fluidized bed is low, making it unsuitable for example for the vatting of sulfur dyes or vat dyes.

A different approach is chosen in U.S. Pat. No. 3,966,571, which discloses a system and a method for high rate electrochemical reactions involving an electrode of loose conductive particles dynamically packed together and against a screen by rapid electrolyte flow. The bed of conductive particles is packed and maintained in contact with the screen that is the current collector. While the highly compact bed leads to a large conductivity of the electrode, rather large particles must be used (average particle diameter of 1 mm) in order to have a sufficient flow although it cannot avoid a significantly high pressure-loss across the compacted fixed bed. This electrode thus has a low reaction surface resulting in a rather inefficient electrolytic process making the proposed process essentially unsuitable for the vatting of indigo.

In WO 2007/147283 an electrochemical reactor for vatting sulphur dyes or vat dyes is described. This reactor comprises at least one liquid compartment in which a multitude of freely suspended non-spherical granules are enclosed. At least one of the side walls of the compartment is an electrode and an opposite side wall is formed by a separator element, typically a membrane. The compartment comprises a bottom inlet and a top outlet for a liquid catholyte or a liquid anolyte. The inlet region as well as the outlet region of the compartment are provided with an upper grid and a lower grid. The width of the mesh and the positioning of the grid is chosen such as to allow the liquid catholyte or the liquid anolyte to pass through from bottom to top but to prevent the granules to pass through the grids to leave the compartment. The upstream flow of the liquid catholyte or of the liquid anolyte can be adjusted so that in operation the multitude of granules is dragged against the upper grid while the lower grid is substantially not in contact with the granules. This cathode has the advantage of a high surface, not very dense packing due to the non-spherical particles and limited pressure loss. However, also this electrode loses efficiency with time and has to be regenerated.

One problem with electrolytic dye reduction reactions is that the cells rapidly lose their efficiency because the electrode surfaces are contaminated. So far no efficient cleaning method exists.

DISCLOSURE OF THE INVENTION

Hence, it is a general object of the invention to provide an improved electrochemical reactor that can be worked batchwise and with no interruption between batches for regeneration of the electrodes and preferably also with reduced maintenance and longer lifecycles between maintenances, as well as a regeneration method.

Now, in order to implement these and still further objects of the invention, which will become more readily apparent as the description proceeds, the electrochemical reactor is manifested by the features that it is suitable for reducing a dye to its leucodye and that it comprises at least four electrolytic cells, wherein the electrolytic cells are provided in the form of at least two stacks of at least two electrolytic cells, said stacks are connected in parallel and allow the separation of at least one stack at a time for washing/regeneration of the cathode and/or the anode during suspension preparation while catholyte solution is circulated through the remaining one or more stacks, wherein the electrolytic cells of each stack are also connected in parallel and wherein the electrolytic cells comprise a cathode compartment and an anode compartment separated by a separator, said cathode compartment comprises a multitude of freely suspended conductive, in particular non-spherical granules in contact with a current collector forming at least the side wall opposite to the separator, said cathode compartment is provided with an upper grid and a lower grid, the width of the mesh and the positioning of said grids is chosen such that the liquid catholyte can pass through them but the granules are prevented from passing through them so that they are retained in the cathode compartment, wherein the anode compartment has a wall opposite the common side wall formed by an electrode, wherein said cathode compartment is connected to a main vessel via a catholyte supply pipe and a reduced catholyte return pipe for circulating catholyte through the cathode compartment, and said anode compartment is connected to an anolyte vessel via an anolyte supply pipe and an anolyte return pipe, wherein said cathode compartment and said anode compartment are also provided with means for supplying acidic cleaning solutions and water and optionally basic solution to the cathode compartment and the anode compartment, said means comprising at least one cleaning medium supply pipe and at least one cleaning medium removal pipe at opposite ends of the cathode compartment and of the anode compartment for supplying and removing acidic cleaning solutions and water and preferably also a basic solution, said cleaning medium supply pipes and said cleaning medium removal pipes can be bypasses of the catholyte supply pipe and/or the anolyte supply pipe, or independent pipes with own inlets and outlets adjacent to the ones of a catholyte circulation loop or an anolyte circulation loop, said at least one cleaning medium supply pipe is connected to at least one vessel for supplying acid and optionally base and is also connected to a water line supplying deionized water, and the at least one cleaning medium removal pipe is connected to a waste water treatment plant (WWTP) or to a waste water vessel.

In the following description some terms are used the meaning of which is further defined below:

The term "suspension" in combinations such as diluted suspension, leucodye comprising suspension in a preferred embodiment also means an electrolyte, in particular a catholyte, provided that the suspension is disclosed as being forwarded to an electrolytic cell.

If all or almost all dye is reduced to the leucodye, such catholyte may also be referred to as catholyte solution or leucodye solution.

The term "basic electrolyte" does not necessarily mean that it has a basic pH, i.e. pH>7, but that it is freshly supplied, i.e. dye-free, electrolyte solution. In general, however it is preferred that the basic electrolyte has basic pH. The term "electrolyte" is used for further diluted basic electrolyte.

The term "pipe" as used herein encompasses all hollow cylinder like means, i.e. not only rigid pipes but also flexible tubes.

The terms "electrolytic" and "electrochemical" are used synonymously herein.

Since upon use the quality of the electrolytic cells declines, the electrodes, in particular the particulate electrode, in general the cathode, but often also the counter electrode, e.g. the anode, have to be regenerated. While usually both compartments, the cathode compartment and the anode compartment are cleaned simultaneously with identical solutions it has now been found that it is advantageous to clean or regenerate, respectively, all anodes and cathodes stackwise, i.e. one stack after the other, and with a time interval. It is e.g. preferred to perform the cleaning/regeneration of the cathodes and the anodes in a subsequent manner, i.e. first the cathodes of all stacks, in a preferred embodiment one stack at a time and during suspension preparation, followed by cleaning all anodes of preferably one stack. Since the cathode is the working electrode, i.e. the electrode of interest for the reduction of indigo and since it is three-dimensional it offers a larger reaction surface but also leads to a higher rate of pollutant absorption and increased difficulty in cleaning. In contrast, the anode is a bidirectional electrode providing the less severe problem that its surface has to be protected from being isolated by fooling. Therefore, it proved advantageous to also clean the anodes stackwise after the cleaning of all cathodes.

A preferred number of stacks is at least 4, more preferred 6. In case of 6 stacks, in general 1 at a time is separated for washing/regeneration. Six stacks are preferred, since in a continuously producing reactor, e.g. a reactor producing one batch a day, it is usually sufficient to regenerate the cathodes once a week, while the anodes need less frequent regeneration, e.g. once all seven weeks is sufficient. For a reactor with 6 stacks this means that the cathodes of all stacks are cleaned after six days and the anodes of one stack are cleaned on the seventh day. Each stack preferably comprises from 1 to 10 electrolytic cells, preferably 4 to 6 electrolytic cells, in particular 5 electrolytic cells. For an electrochemical reactor suitable for producing 1000 kg of leucodye, in particular leucoindigo solutions of a concentration of e.g. 30% within 24 h, an electrochemical reactor with 6 stacks of 5 electrolytic cells each has proved suitable, in particular for electrolytic cells with a cathode compartment having the following dimensions and a particulate carbon cathode:

- 0.3 $m^2$ separator area per cell
- Dimensions of the cathode compartment containing particulate graphite carbon are 0.4 m high, 0.7 m large and 0.04 m thick
- Dimensions of the carbon granules are between 1 mm to 0.3 mm
- Dimensions of the stainless steal cathode current collector and the anode are 0.6 m high and 0.9 m large Further information on a suitable electrode can be found in WO 2007/147283 A2 the disclosure of which is incorporated herein by reference in its entirety. Such information regards e.g. the determination of the sphericity of the granules and the flow properties.

Cleaning the electrodes during suspension preparation has the advantage that all stacks remain in leucodye production, and since the preparation of a fresh suspension in the batch procedure takes at least 1 hour while longer, i.e. up to two hours, circulation through ultrasound apparatuses improves the suspension quality, there is almost the same time needed for careful cleaning/regeneration of the electrodes and suspension preparation. Thus, performing the two steps simultaneously does not or only minimally extend the time needed anyway.

At least the cleaning of the cathodes of one stack only at a time has several advantages, namely

- the water needed for suspension preparation can be supplied via the cathodes of the stack to be regenerated thereby avoiding loss of leucodye,
- the water needed for suspension preparation is sufficient to remove all leucodye from one stack but might be less efficient in the case of several stacks,
- since the cleaning solutions are recycled, lower amounts of cleaning solutions are needed.

In the case of 6 stacks they are preferably connected such that at any time one of them can be separated for being supplied with cleaning medium or water while the remaining stacks are connected such that at least the catholyte solution comprised in the stacks and the connecting pipes can be circulated through them.

It is also preferred that the first vessel and/or the main vessel used for catholyte preparation are connected with the cathode compartments of the electrolytic cells such that they can be supplied with water through the cathode compartments of each one of the stacks separated for regeneration independently. This allows to minimize the loss of leucodye while profiting from the suspending effect of this leucodye in addition to the leucodye solution retained in the main vessel or in the first vessel.

In one embodiment, the electrochemical reactor further comprises circulation means allowing the acidic cleaning solution and optionally the basic solution to be circulated via the cathode compartment and/or the anode compartment prior to being removed. These circulation means preferably comprise at least one particle filter and/or at least one adsorption filter.

In another embodiment the cleaning medium supply pipes are connected with the catholyte supply pipes and/or the anolyte supply pipes that are feeding each stack.

In a further embodiment each anode and preferably all anodes of each stack are connected with the cleaning solution and water supply pipes such that each anode or stack can be individually controlled and either washed simultaneously with the respective cathodes or separately.

In general the anodes of one stack are connected such that they can be washed simultaneously. While also the anodes of all stacks might be connected for simultaneous washing since loss of anolyte is less critical than loss of catholyte, it proved advantageous to also clean the anodes stack by stack and—presently much preferred—one stack at the end of a full cathode washing cycle. In the case of 6 stacks this means that on day 1 the cathodes of a first stack are washed, on day two the cathodes of a second stack and so on until the cathodes of the sixth stack are washed on day 6, followed by washing all anodes of a first stack on day 7. On day 8 the cycle starts again with washing the cathodes of all stacks on days 8 to 13 and the anodes of the second stack on day 14 etc. Since all washings are performed during suspension preparation, dead time of any of the stacks is eliminated.

In general the non soluble dye will be reduced to the better soluble leucodye. Thus, the dye/leucodye suspension is the catholyte. The following description will therefore describe this situation only.

Further improvement of the electrochemical reactor is obtained if for preparing a dye suspension to be reduced, a catholyte, a main vessel is provided that comprises a dye inlet, an electrolyte inlet, a catholyte outlet connected to a catholyte supply pipe equipped with a catholyte supply pump for supplying catholyte to the cathode compartment and a reduced catholyte inlet for reduced catholyte. The catholyte supply pipe is preferably equipped with a particle filter for removing oversized particles, in particular particles of >50 to 150 μm and/or a heating means (heat exchanger) for raising the temperature to e.g. about 50° C. to 65° C., preferably 60° C., for indigo. Optionally, the catholyte supply pipe can also be equipped with an ultrasound apparatus. In a much preferred embodiment, the main vessel also comprises a main suspension circulation loop equipped with a main suspension circulation pump and preferably also with an ultrasound apparatus. This main suspension circulation loop can be a separate loop or provided as a bypass to the catholyte supply pipe, i.e. leaving the main vessel at the catholyte outlet and being returned via the reduced catholyte inlet but not passing via the cathode compartment and also only optionally via the heating means and in general not via the filter. A presently preferred ultrasound apparatus is a cylindrical ultrasound apparatus. The main suspension can be circulated through the main suspension circulation pipe for a time sufficient to generate a homogeneous dye suspension, the catholyte, preferably already having desired temperature and only few oversized particles.

As an alternative to introducing solid dye into the main vessel, the solid dye can be provided to a first vessel upstream of the main vessel, suspended therein and then supplied to the main vessel, wherein the suspension can be further diluted to desired dilution if not already done so in the first vessel and optionally circulated as described above. This results in an improved catholyte that is then supplied to the electrolytic cells.

This first vessel preferably comprises a first suspension circulation loop equipped with a first suspension circulation pump and preferably an ultrasound apparatus, more preferred a cylindrical ultrasound apparatus. The dye suspension in the first vessel is also prepared by circulating it through the circulation loop for a time sufficient to generate a suspension of desired homogeneity, i.e. with dye particle sizes below 50 μm. In case of a first vessel with an ultrasound apparatus in its circulation loop, it is possible to abstain from an ultrasound apparatus in the circulation loop of the main vessel or of a circulation loop of the main vessel at all, although their presence is preferred.

The main suspension circulation loop of the first vessel could optionally be equipped with a particle filter for removing oversized particles, in particular particles of >50 to 150 μm, however, it is preferred that such filter is part of the catholyte circulation loop.

Irrespective of the actual method used for suspension preparation, the time needed proved to be sufficiently long for thorough cleaning/regenerating of the cathode by washing it with acidic solution, followed from rinsing with water, optionally after washing with basic solution.

Since the presence of oxygen has to be avoided, the cathode part of the reactor is operated under inert gas atmosphere, in general nitrogen that can be supplied and removed at any place in the catholyte circuit provided that inert atmosphere is upheld over the whole circuit. A preferred place for nitrogen supply and removal (in general together with hydrogen generated during electrolysis) is at the top of the main vessel.

In one embodiment, a catholyte, is prepared and circulated from the main vessel through a catholyte outlet in a lower part of the main vessel, preferably at the bottom of the main vessel, to an inlet into a cathode compartment of an electrolytic cell, then through the compartment, out through an outlet situated opposite to the inlet, and back through a reduced catholyte inlet in an upper part, preferably at the top of the main vessel. This circulation can be performed until the power in the electrolytic cells falls below a threshold power. Since the amount of dye that can be introduced into a sufficiently stable suspension is limited, unless a high amount of dispersing agent is added, and if a more concentrated final leucodye solution is desired, leucodye solution from the electrolytic cells is supplied to the first or—if no first vessel is present—the main vessel to be supplemented with further dye in order to finally end up with a leucodye solution of desired concentration. Once the solution is sufficiently concentrated it is removed and either stored or directly supplied to a dyeing plant.

In general more than one electrolytic cell and more than one stack are connected to the same catholyte vessel or anolyte vessel, respectively.

A first vessel is especially suitable in cases, where the solid dye is added in portions, since in a first vessel the suspension can be circulated to improve the suspension, in particular to diminish the dye particle sizes, without interrupting the circuit through the electrolytic cells as would be the case if circulation would be performed in the main vessel.

Upon withdrawal of the leucodye solution, a small part of the leucodye solution (e.g. 200 to 300 l) can be left in the main vessel, diluted with fresh water (e.g. supplied via the cathodes of the at least one stack separated for cathode regeneration) and electrolyte and then used in the preparation of fresh dye suspension. In case of a first vessel, the main vessel is provided with a leucodye return pipe connecting a leucodye outlet at the bottom of the main vessel with a leucodye inlet in the first vessel. In case of a first and a main vessel, the dilution of the leucodye solution with fresh electrolyte can be performed in one of the vessels, in both vessels simultaneously or partial dilution in the first vessel and final dilution in the main vessel.

The anode compartment, also has an anolyte inlet and an anolyte outlet at opposite sides of the compartment, both connected via an anolyte circulation loop comprising respective pipes, also termed anolyte circulation pipes, an anolyte vessel and an anolyte circulation pump and preferably also a heating means like a heat exchanger. Since in general oxygen is generated at the anode, an oxygen outlet is provided, preferably at the top of the anolyte vessel.

In a preferred embodiment of the electrochemical reactor the anolyte circuit is provided with an adsorbtion filter for removing molecular impurities. Suitable adsorbents are e.g. activated carbon or molecular sieves, preferably activated carbon.

This adsorption filter removes molecular impurities that are e.g. present in the raw material as secondary products and migrate through the separator common to both compartments, a grid or in particular a semipermeable membrane. It has been found that such molecular impurities can react in the anode compartment, e.g. through anodic oxidation, thereby forming polymers or other insoluble substances that might deposit on the anode and affect its performance. Such impurities comprise—e.g. in case of indigo—aniline. The presence of such adsorption filter improves the lifetime of the anode and assists in performing the cleaning of the anodes stack by stack at larger intervals.

Such adsorption filter can optimally be used if no process chemicals, such as suspending agents other than the dye/leucodye are used since possibly migrating process chemicals and their removal from the anode compartment might destabilize the catholyte and enhance the amount of adsorption material needed.

As already indicated above and also for environmental and health reasons it is desired to perform the dyeing with as few as possible additional chemicals. In the scope of this invention it has also been found that leucodyes such as leucoindigo have a suspending effect for the dye like indigo. If no pure leucodye is available, the reduction or leucodye production method, respectively, in an electrochemical reactor of the present invention and preferably in the absence of any dispersing agent can be started in that (i) a diluted suspension of dye in electrolyte is prepared in the main vessel or in the first and the main vessel by circulating and heating the suspension, optionally by improving the suspension by circulating it through one or more ultrasound apparatuses, (ii) the diluted suspension of step (i) is electrochemically treated in the electrolytic cells to obtain a diluted leucodye solution, (iii) the diluted leucodye solution of step (ii) can optionally be forwarded into the first vessel or the main vessel and there supplied with further dye to obtain a leucodye comprising suspension by circulating and heating, (iv) the leucodye comprising suspension of step (iii) is then circulated through the electrolytic cells for electrolytic conversion of the dye to the leucodye or the leucodye comprising suspension to a leucodye solution, respectively, optionally (v) repeating steps (iii) and (iv) one or is more times with the solution of step (iv) and further dye to form a leucodye solution.

Steps (iii) to (v) are optional, i.e. they are only performed if the leucodye concentration obtained in step (ii) is not sufficiently concentrated to provide suitable suspending effect.

For indigo as a preferred example, the dye suspension in step (i) preferably has a concentration of 100 to 200 g/l in electrolyte, e.g. sodium hydroxide of a concentration of 2 to 10% w/v, preferably 4% w/v. The indigo suspension in a first step (iii) has a concentration of indigo and leucoindigo of 150 to 250 g/l, in a second step (iii) of 250 to 350 g/l and in a third step (iii) of 300 to 380 g/l.

Concentrated leucodye solution can be prepared starting with leucodye comprising electrolyte. This leucodye comprising electrolyte is either produced as indicated above or stems from a former production of concentrated leucodye. In the second case, some of the leucodye solution is left in the reactor upon removal of the batch of concentrated leucodye solution. This concentrated leucodye solution is then diluted with electrolyte to form leucodye comprising electrolyte solution.

Producing a concentrated leucodye solution in an electrochemical reactor of the present invention using such leucodye comprising electrolyte solution can be performed in that (i) a first part of a dye to be reacted to leucodye is added to a leucodye comprising electrolyte solution in the first vessel or in the main vessel and circulated, optionally through one or more ultrasound apparatuses and preferably heated to form a first catholyte,
(ii) forwarding the first catholyte of step (i), preferably via a filter for removing oversized particles and a heating means, into the electrolytic cells and
(iii) starting the electrolytic cells by stepwise enhancing the voltage to conversion voltage and maximum conversion power,
(iv) adding a further part of dye to be reacted thereby enhancing the power, preferably to maximum power and continuing conversion,
(v) optionally repeating step (iv) until desired concentration of the leucodye is achieved,
(vi) converting the dye to leucodye until the power diminishes to a threshold conversion power due to dye conversion,
(vii) removing the leucodye solution.

As indicated above, at least part of the water needed for diluting the basic electrolyte solution to form the electrolyte solution in step (i) is supplied via the cathode compartments of at least one stack provided that said stack has been separated from the other stacks for cathode regeneration.

The addition of further dye (steps (iv) and (v)) can be performed by adding solid dye into the main vessel or by feeding part of the leucodye comprising solution or suspension from the main vessel or the catholyte circulation loop into the first vessel where it is diluted with basic electrolyte, water and solid dye and circulated for forming a suitably homogeneous suspension that is then fed to the main vessel.

In general and in particular for indigo it has been found that a leucodye solution in electrolyte with a leucodye concentration of only 5% w/v is able to stably suspend up to 20% w/v of dye, such as from 5 to 10% w/v leucodye for 10 to 20% w/v dye.

A good final leucoindigo solution is e.g. obtained with 300 kg of indigo in 1000 to 1500 l electrolyte.

For producing such a concentrated leucoindigo solution the following procedure has proved to be good:

For starting, part of the leucoindigo solution is left in the main vessel or pumped into the first vessel for being supplemented with basic electrolyte, water and indigo. It has been proved suitable to retain about 200 l leucoindigo solution in the vessel that is then supplemented with 300 to 600 l of basic electrolyte and water supplied via the separated at least one stack thereby providing further leucoindigo solution from the cathode compartments and the pipes to the main vessel. Due to further leucoindigo solution in the pipes and electrolytic cells of the other stacks etc. the leucoindigo concentration is enhanced as soon as mixed with the content of the pipes, cells etc. Thus, although a 5% leucoindigo concentration is enough for stabilizing a suspension with up to 20% of indigo, in general higher leucoindigo concentrations are used. Volume information given below refers to the volume in the first and the main vessel.

A first part, e.g. 150 kg, of indigo to be reacted to leucoindigo is added to 500 l of a leucoindigo comprising electrolyte solution (preferably leucoindigo concentration 15% to 20%, NaOH concentration 2% to 10%, in particular about 4%) in the first vessel or—if no first vessel is present—in the main vessel and circulated, optionally through one or more ultrasound apparatus, and heated to form a first indigo suspension. If a first vessel is present, the suspension is circulated through the first vessel and an ultrasound apparatus for about 30 min. Once pumped into the main vessel it is again circulated for about 20 min. through a second ultrasound and—at least when ready for supply to the cathode—through a particle filter and a heat exchanger.

Once the suspension is homogeneous (indigo particle size under 50 μm) and has the desired temperature of about 50° C. to 65° C., preferably 60° C., and the separated at least one stack is regenerated and rejoined with the other stacks in parallel, the first indigo suspension is forwarded into the electrolytic cells of all stacks. The electrolytic cells are then started by stepwise enhancing the voltage to conversion voltage and maximum conversion power, e.g. from 7 volt to 11 volt in steps of 0.5 volt about each two min. All cells of one stack and preferably also all stacks are simultaneously fed and started. The preparation of step (i) takes about 1 hour (if regeneration needs more time circulation can be extended to up to two hours), starting the electrochemical process about 15 min.

At the maximum conversion voltage of 11 volt, the conversion power is about 170 A for an indigo suspension comprising 150 kg indigo in 500 to 800 l leucoindigo catholyte. As soon as the maximum current is reached, further indigo, e.g. 50 kg in leucoindigo solution, is prepared in the first vessel and supplied to the main vessel resulting in again enhanced current and the reduction is continued. The leucoindigo solution used for suspending the indigo in general is diluted with electrolyte to a leucoindigo concentration of 5 to 20%, more preferred 10 to 20% weight per volume (w/v).

Once all the indigo has been added, e.g. 3 times 50 kg in about 150 to 400 l to a total of 300 kg in 1000 to 1500 l electrolyte, the power diminishes with the decreasing indigo concentration. Since no further indigo shall be supplied, the voltage is also slowly reduced dependent on the measured power or dependent of the indigo concentration, respectively.

A further problem with particulate electrodes in combination with suspensions is clogging, resulting in reduced electrolyte transport through the particulate electrode and/or to enhanced pressure.

In order to avoid any clogging of the particulate electrode that would also affect the regeneration process, the electrolyte circuit direction, i.e. the electrolyte flow direction, preferably is regularly inverted, e.g. all 3 minutes. Since the electrolysis shall not be affected by the inversion of the flow direction it is important that the packing of the particulate bed of the electrode in both directions is the same. This is obtained by ensuring that the flow and the particulate bed are so that the bed is always tightly pressed against the upper grid or the lower grid retaining the particles within the electrode compartment.

Dependent on the kind of electrode the electrolyte direction of the cathode and optionally also the anode can be inverted.

While a preferred electrode position is vertical position with the electrolytes flowing from bottom to top or from top to bottom, it is also possible to place the electrodes with an inclination that may be close to horizontally but preferably retaining a slope for easier gas ($O_2$ or $H_2$) removal.

Since—as already mentioned above—the use of as few chemicals as possible is desired, in a preferred method of the present invention the leucodye is the sole dispersing aid.

Throughout the present invention, the preferred dye is indigo and the preferred leucodye is leucoindigo.

Another subject matter of the present invention is a method for cleaning a particulate electrode in an electrochemical reactor of the present invention comprising washing the particulate electrode with strong acids (pK<1) by circulating the acidic solution through the electrode bed, followed by washing the bed with water, optionally and preferably after having washed the acid treated bed with a basic solution, preferably caustic soda, for more efficient acid and electrode contamination removal.

This washing step is particularly suitable for particulate carbon based electrodes, preferably cathodes, since it removes metals from the particle surface. Such metals can be present in the particles themselves or brought onto the particles during electrolysis. These metals, in general mainly iron and/or nickel and/or copper in metallic or ionic or complexed form, can have a catalytic effect on $H_2$-generation that competes the desired reduction and thus has to be avoided.

In a reactor with several stacks as described above, such cleaning/regeneration method for electrochemical cells comprising a particulate cathode comprises the following steps:

- removing the catholyte solution except the amount needed for suspension preparation and the amounts filling the electrochemical cells and their connecting pipes,
- separating at least one stack at a time for washing/regeneration of the cathodes during catholyte suspension preparation,
- circulating catholyte solution through the not separated one or more stacks,
- supplying deionized water through the cathode compartments of the separated at least one stack of electrolytic cells into the main vessel or the first vessel,
- isolating the separated at least one stack (5) from any catholyte suspension preparation and/or circulation,
- washing at least the cathode compartments of the separated at least one stack with acidic solution,
- optionally washing at least the cathode compartments of the separated at least one stack with basic solution, then
- rinsing the acid and optionally base washed compartments of the separated at least one stack with deionized water until neutral,
- joining the separated at least one stack (5) with the other stacks and starting catholyte reduction, wherein the washing and rinsing is performed by supplying the washing solution or the rinsing water to one end of the electrochemical cell and removing it at the opposite end and wherein the washing solutions and the rinsing water removed from the compartments are forwarded to a waste water treatment plant (WWTP) or to a waste water vessel.

In one embodiment of the regeneration method all anodes of one stack are cleaned together during the preparation of a new batch of catholyte suspension but separately from cathode cleaning. Such anode washing comprises the following steps:

- removing the catholyte solution except the amount needed for suspension preparation and the amounts filling the electrochemical cells and their connecting pipes,
- separating at least one stack at a time for washing/regeneration of the anodes during catholyte suspension preparation,
- circulating catholyte solution through all stacks,
- washing the anode compartments of the separated at least one stack with acidic solution,
- optionally washing the anode compartments of the separated at least one stack with basic solution, then
- rinsing the acid and optionally base washed compartments of the separated at least one stack with deionized water until neutral,
- joining the separated at least one stack with the other stacks and starting catholyte reduction, wherein the washing and rinsing is performed by supplying the washing solution or the rinsing water to one end of the anode compartments and removing it at the opposite end and wherein the rinsing water removed from the anode compartments is forwarded to a waste water treatment plant (WWTP) or to a waste water vessel.

In e.g. indigo reduction, the acid washing is performed for a suitable time such as 10 to 60 min. followed by washing the bed with a base like caustic soda (to remove the acid and contamination of the electrode) followed by water washing or—less preferred—by washing with water directly. Preferably the washing is performed for both electrodes, i.e. the cathode and the anode, subsequently as described above.

Suitable acidic solutions comprise the acid, e.g. HCl, in a concentration in the range of 10 to 100 g/l, more preferred 40 to 60 g/l, most preferred about 50 g/l, or 0.25 to 30 M, preferably 1 to 2 M, more preferred 1.3 to 1.4 M (referred to the protons) in deionized water.

For the washing step the strong acid is preferably selected from the group consisting of HCl, $H_2SO_4$, $HNO_3$ and mixtures thereof.

For more efficient cleaning and contamination removal from the electrode the acid cleaning solution is circulated through the cathode compartment and/or the anode compartment followed by washing with deionized water.

The acid cleaning solution is e.g. circulated for 20 to 60 min.

The water washing is preferably not performed by circulation but by flowing deionized water from a water source through the electrodes and then directly to the waste water treatment plant. The water washing is suitably performed until ionic load is below a threshold value like e.g. 1 mS $cm^{-1}$.

In a preferred embodiment the electrodes are additionally washed with a basic solution between the treatment with acidic cleaning solution and the washing with water. The basic solution preferably comprises a strong base, i.e. a base with $pK_a$>10 in particular caustic soda. The basic solution comprises the base, e.g. the caustic soda, in a concentration of in general 10 to 100 g/l, more preferred 20 to 60 g/l, most preferred 40 g/l, or 0.1 to 2.5 M, preferably 0.5 to 1.5 M, most preferred about 1 M (referred to the hydroxide ions) in deionized water. Also the basic solution is preferably circulated through the cathode compartment and/or the anode compartment. A suitable circulation time is e.g. 5 to 15 minutes.

The washing step of the present invention is particularly suitable for particulate carbon based electrodes like graphite electrodes, preferably cathodes, since it removes metals from the particle surface. Such metals can be present in the particles themselves or brought onto the particles during electrolysis. These metals, in general mainly iron and/or nickel in metallic or ionic or complexed form, can have a catalytic effect on Hz-generation that competes the desired reduction and thus has to be avoided.

When the acidic cleaning solution and/or the basic solution are circulated through the cathode compartment and/or the anode compartment, in particular in the case of a particulate carbon electrode, they may carry with them small particles but also molecular compounds. Therefore, it is preferred to circulate at least the acid cleaning solution through at least one particle filter and/or at least one adsorption filter, more preferred also the basic solution.

BRIEF DESCRIPTION OF THE DRAWINGS

The invention will be better understood and objects other than those set forth above will become apparent when consideration is given to the following detailed description thereof. This description makes reference to the annexed drawings, wherein.

MODES FOR CARRYING OUT THE INVENTION

The invention is now further described based on the Figures for a preferred dye reduction plant, in particular an indigo reduction plant.

In spite of all the improvements described in the scope of the present invention that result in a cleaner process and thus longer intervals between maintenance activities, cleaning or regeneration, respectively, is nevertheless necessary since the quality of the electrolytic cells 4 declines with continued use. The optimal number of stacks 5 in view of such regeneration depends on the dimensions and numbers of the electrolytic cells 4 per stack 5, the volume of the electrolytic cells 4 and the pipes, the amount of dye to be reduced in a certain time etc.

Figure 1:
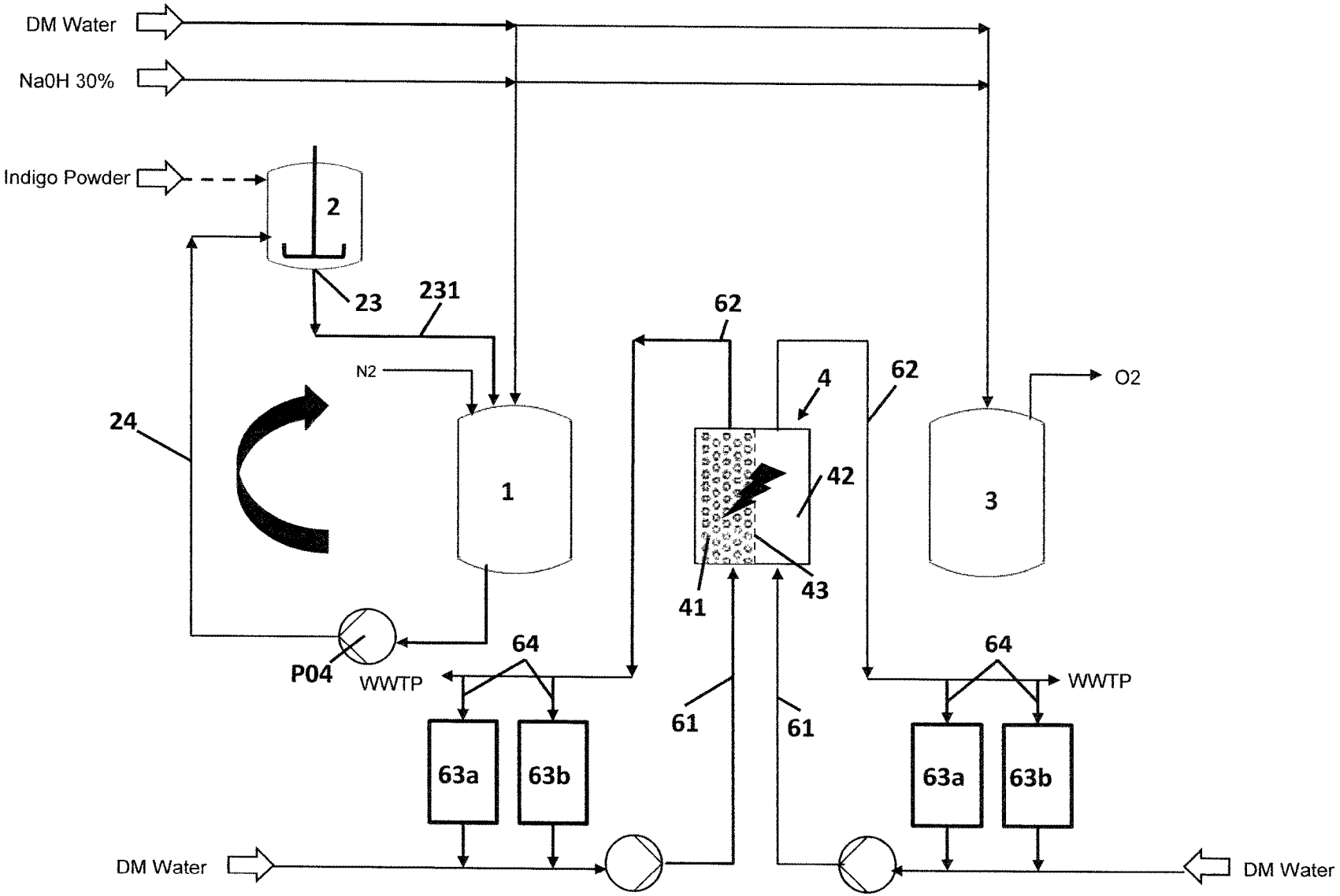
FIG. 1 schematically shows a reactor with one electrolytic cell and a cleaning cycle for both electrode compartments. The catholyte and anolyte circulation loops are omitted for clarity reason. There is no circulation of anolyte and/or catholyte in the electrolytic cell during washing.
Figure 2A:
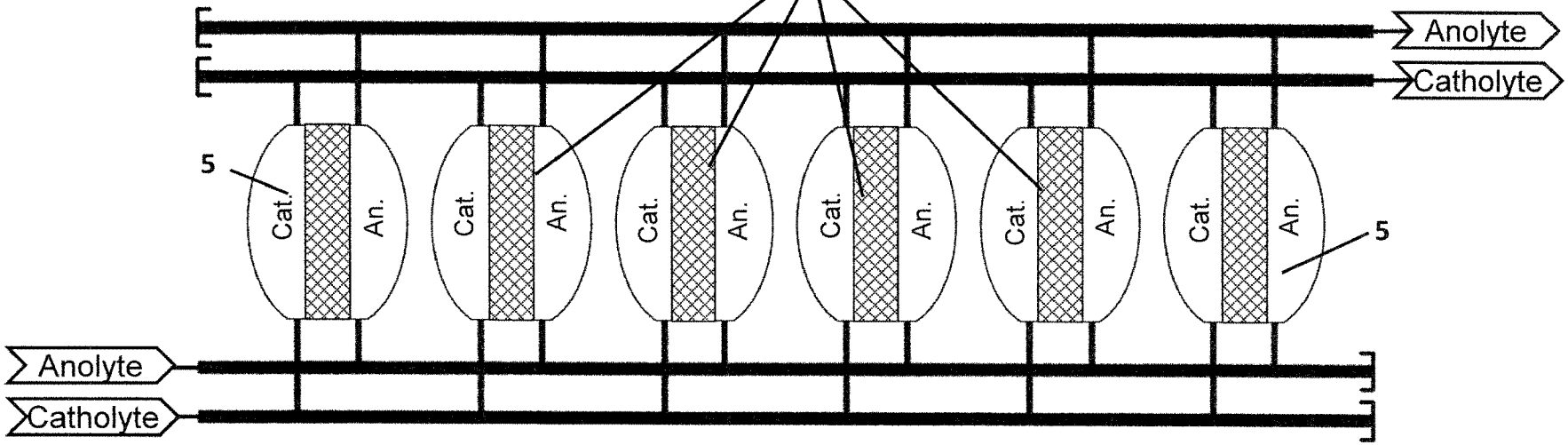
FIG. 2*a* shows schematically six stacks with five electrolytic cells each with the relevant supply and withdrawal lines and FIG. 2*b* shows one stack with five electrolytic cells more detailed.

If a reactor e.g. comprises six stacks 5 as shown in FIG. 2*a*, one of them can be separated for cathode or anode regeneration at a time, as shown in FIG. 1. In particular in case of dye reduction, this regeneration can be performed during the usual process, namely during dye suspension preparation, so that reduction can be performed with all stacks together. Nevertheless, it may be advantageous to provide a reactor with so many stacks 5 that it can be operated at full production capacity even if one of the stacks 5 is separated for maintenance, i.e. for a time exceeding the suspension preparation.

The separation and regeneration of one of the stacks 5 at a time only is preferred for the reasons already indicated above.

Although in particular the particulate electrodes, in general the cathodes, have to be regenerated also the anode quality may suffer from use. Therefore also the anodes are cleaned although preferably separate from cathode cleaning and at longer intervals. Separate cleaning of cathodes and anodes allows better adaptation of the cleaning parameters.

For this cleaning or regeneration step, the electrochemical reactor is provided with means for supplying cleaning solutions to the stacks 5 of electrolytic cells or rather the electrolytic cells 4 themselves. These means comprise at least one cleaning medium supply pipe 61 for supplying cleaning/regeneration solutions to the cathode or anode and—on the side of the electrolytic cell opposite to the inlet—at least one cleaning medium removal pipe 62 for removing acidic cleaning solutions and water and preferably also a basic solution. These cleaning medium supply pipes 61 can be bypasses of a catholyte supply pipe 151 and an anolyte supply pipe 31, i.e. using the same inlets and outlets, or independent pipes with own inlets and outlets adjacent to the ones of the catholyte circulation loop 15 or the anolyte circulation loop 33. In general, the one or more cleaning medium supply pipes 61 are connected to acid vessels 63*a* for supplying acid, and optionally to base vessels 63*b* for supplying base, as well as to a water line supplying deionized water. The one or more cleaning medium removal pipes 62 are either directly fed to a waste water treatment plant (WWTP) or to waste water vessels for storing waste water. In a preferred embodiment, the cleaning solutions are circulated for some time, i.e. until their pollution reaches an undesired level. In case of circulation, the cleaning medium removal pipe 62 is connected to a vessel 63*a*, 63*b* via cleaning medium circulation means 64. In this case it is preferred to have the cleaning medium circulation means equipped with one or more particle filters and/or adsorption filters, preferably just downstream the electrolytic cells.

Cleaning or regenerating, respectively, a particulate electrode or both electrodes in an electrochemical reactor of the present invention comprises washing the cathode and/or anode compartments 41, 42, in particular the bed or the particulate electrode, respectively, with strong acids (pK<1) by circulating the acidic solution through the compartments 41, 42, in particular the electrode bed, followed by washing the compartment(s) 41, 42, in particular the bed with water, optionally and preferably after having washed the acid treated compartment(s) 41, 42 with a basic solution, preferably caustic soda, for more efficient acid and electrode contamination removal.

In case of indigo reduction, the acid washing is performed as already described above.

Figure 2B:
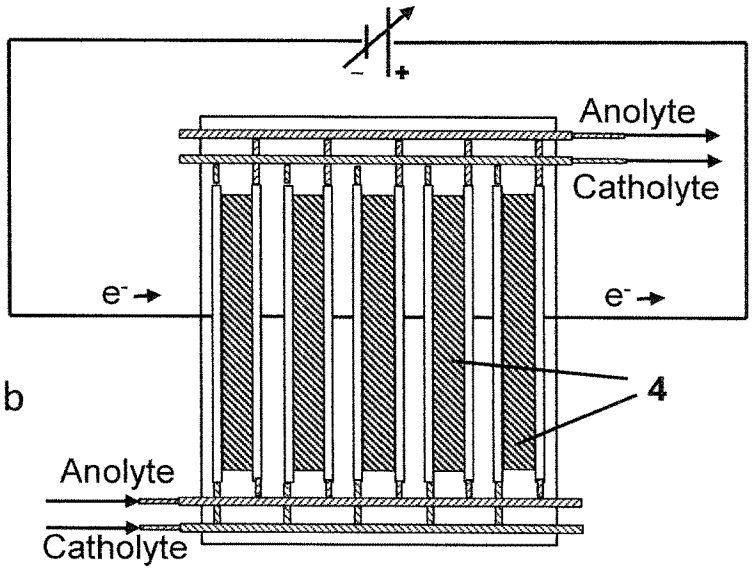
Figure 3:
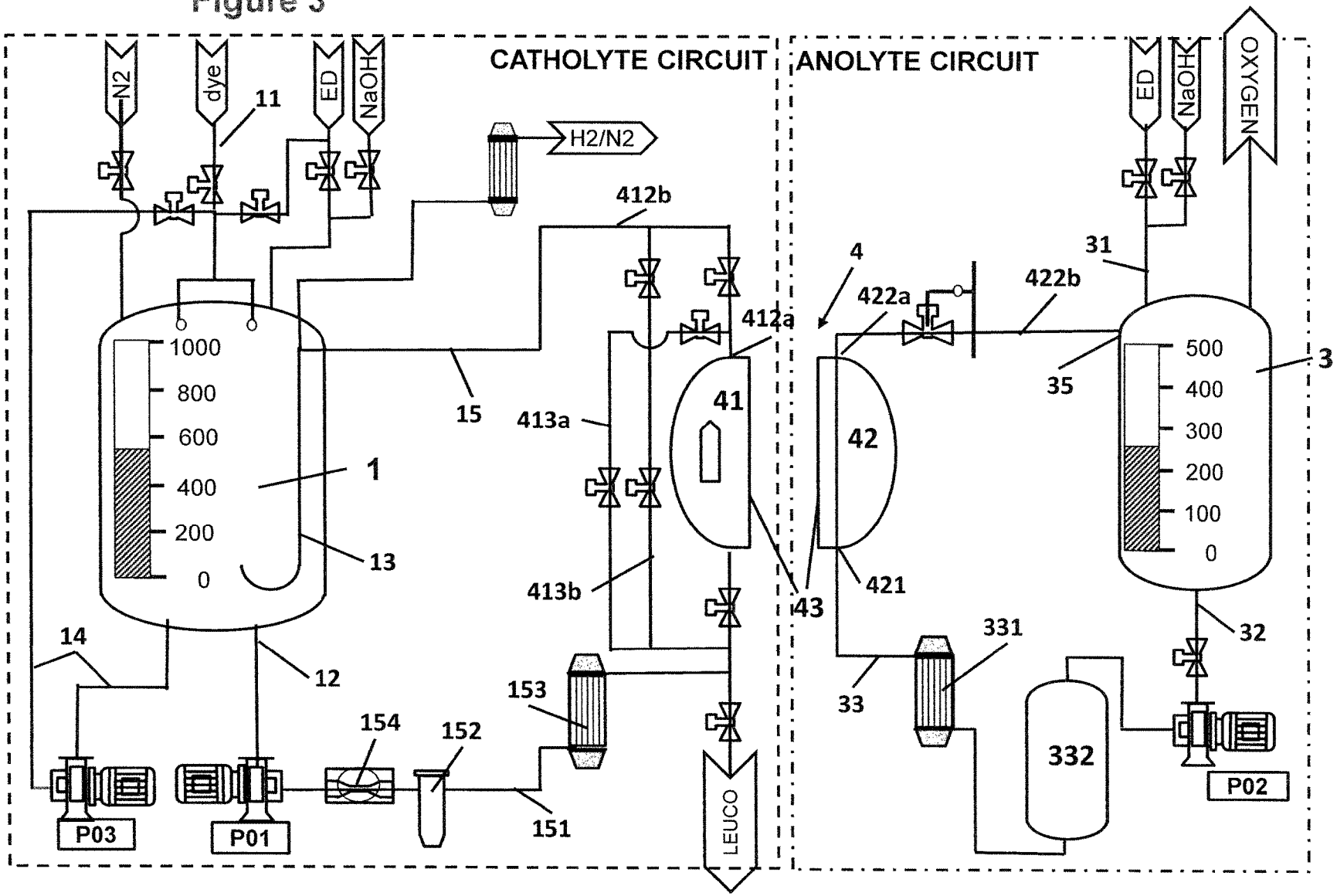
FIG. 3 shows the main parts of a whole electrochemical reactor with the electrolytic cell in exploded view. For clarity reason, the first vessel and the first suspension loop is not shown.

FIG. 3 shows the core of an electrochemical reactor of the present invention with only one electrolytic cell 4 for clarity reasons and with an inlet 11 for dye in solid or suspended form, i.e. transferred from a first vessel 2. An assembly of six stacks is shown schematically in FIG. 2*a*, and one stack more in detail with five electrolytic cells is shown in FIG. 2*b*. All stacks 5 and all electrolytic cells 4 are connected in parallel.

The main vessel 1 is provided with a main suspension circulation loop 14 comprising a main suspension circulation pump P03 and preferably an ultrasound apparatus 141 for circulating the suspension thereby improving its homogeneity.

When the suspension has been circulated for some time (dependent on the quality of the dye, i.e. its particle size and particle distribution) the main suspension circulation loop 14 is closed and the valve to the catholyte outlet 12 is opened. The catholyte is then circulated through catholyte circulation loop 15 by pumping it by the catholyte pump P01 via catholyte supply pipe 151 through a further optional ultrasound apparatus 154, a particle filter 152 for removing oversized particles if still present and a catholyte heating means (heat exchanger) 153 via catholyte inlet 411 into the cathode compartment 41 of the electrolytic cell 4 separated from the anode compartment 42 by a separator 43, preferably a semipermeable membrane. After having passed the cathode, the catholyte is returned to the main vessel 1 via reduced catholyte outlet 412*a*, reduced catholyte return pipe 412*b* and reduced catholyte inlet 13. As indicated by reference numbers 413*a* and 413*b*, in a preferred embodiment the catholyte direction can be inverted.

An anolyte is supplied to anolyte vessel 3 via anolyte supply pipe 31 or—once the reduction has been started—anolyte inlet 35 and supplied to the anolyte compartment via anolyte outlet 32, anolyte pump P02, anolyte heating means 331 and anolyte inlet 421 into the anode compartment 42. Having left the anode compartment 42 via anolyte outlet 422*a*, the anolyte is recirculated to anolyte vessel 3 via anolyte return pipe 422*b* and anolyte inlet 35.

In a preferred embodiment an adsorption filter 332 is provided within the anolyte circuit. This filter 332 can be placed anywhere, however it is preferably placed just before the anolyte heating means 331 since there the temperature is lowest and thus adsorption best.

All vessels are in addition provided with supply means for nitrogen, caustic soda and optionally further supply means as well as with degassing means and solution withdrawal lines for the withdrawal of the leuco dye or the anolyte in case of anode cleaning.

FIG. 2*a* shows schematically 6 stacks, all connected in parallel. Due to independent anolyte and catholyte supply to each of the stacks, any one thereof can be independently shut down for regeneration. In case one stack 5 is separated for cathode washing, water is supplied to the separated stack 5 via catholyte inlet 411, removed through reduced catholyte outlet 412*a* into reduced catholyte return pipe 412*b* and forwarded to the main vessel or to the first vessel for suspension preparation.

Figure 4:
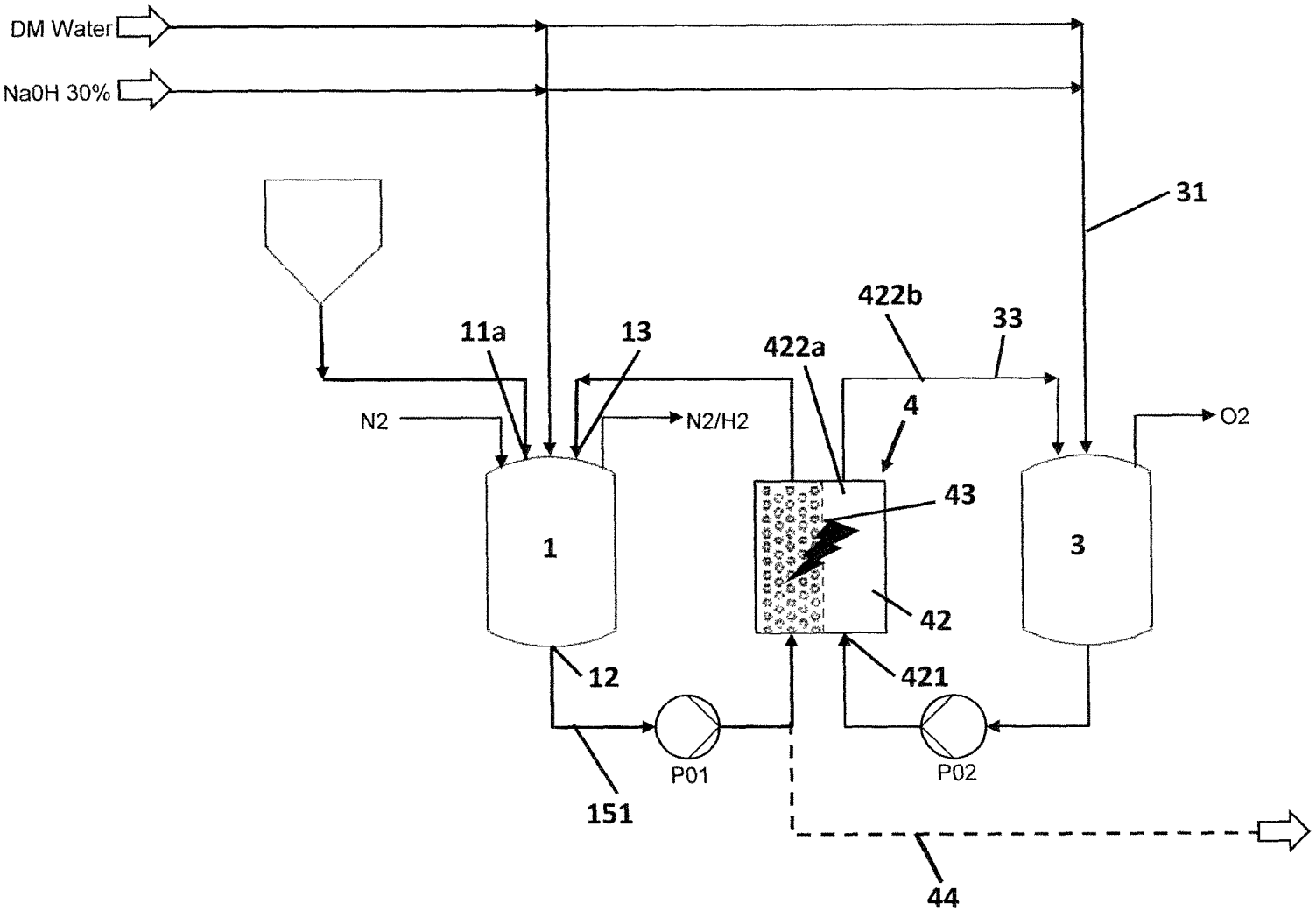
FIG. 4 schematically shows dye introduction in powder form directly into the main vessel.

FIG. 4 shows catholyte preparation in the main vessel 1 directly. Dye in solid form is introduced into main vessel 1 containing caustic soda in desired concentration as electrolyte (for indigo e.g. caustic soda of 2 to 10%, preferably about 4% w/v) via solid dye inlet 11*a*. The main vessel 1 and all pipes and apparatuses that are in contact with leucodye once the reduction process is started are purged with nitrogen (or other inert gas), e.g. introduced into main vessel 1, in order to prevent oxidation of the once reduced dye. After having been circulated as described with regard to FIG. 3 (circulation loop not shown in FIG. 4), the thus formed catholyte is circulated via the cathode compartment 41, driven by pump P01, until all dye has been reduced to leucodye.

Figure 5:
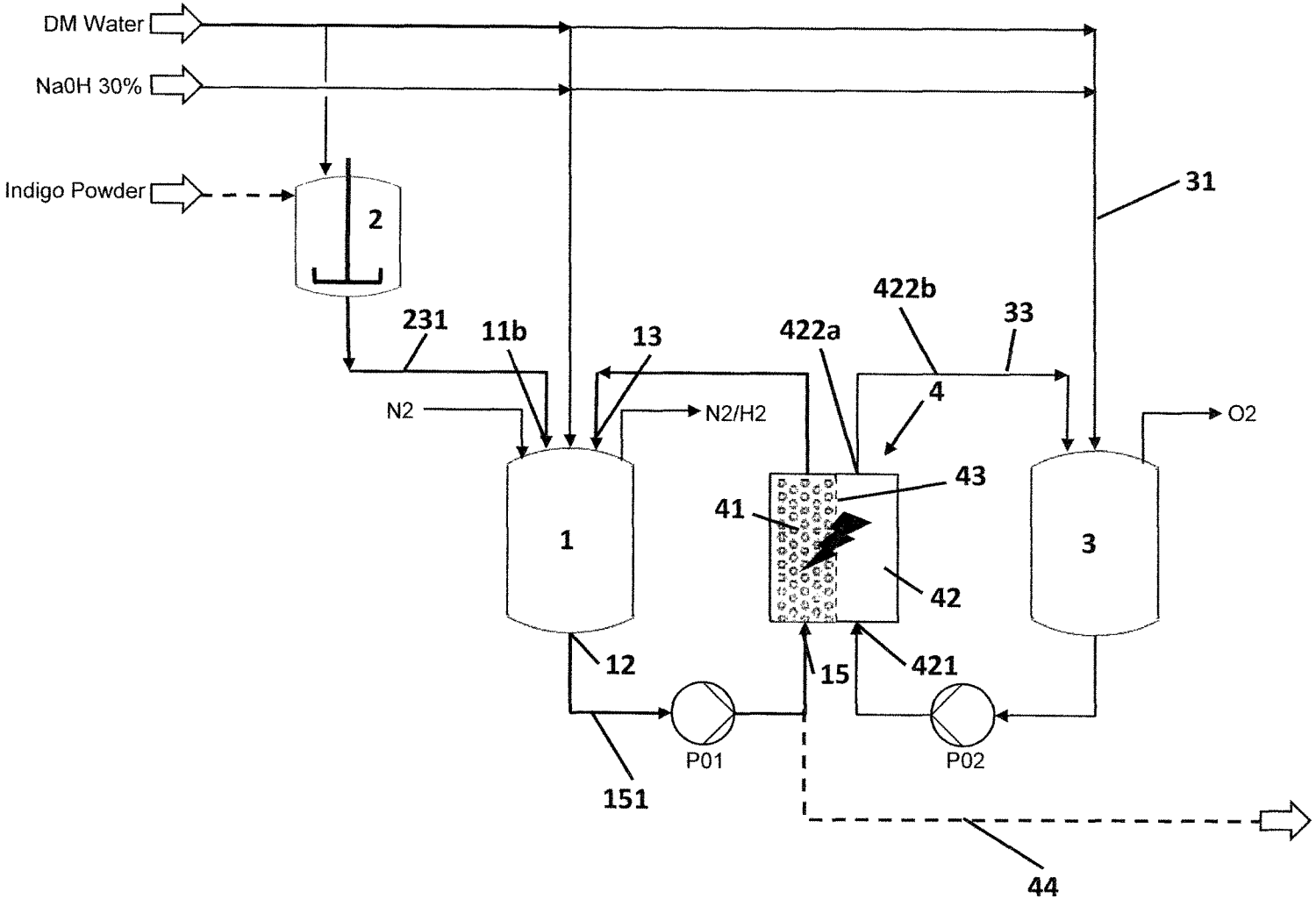
FIG. 5 schematically shows dye suspension preparation in the first vessel and supply to the main vessel.
Figure 6:
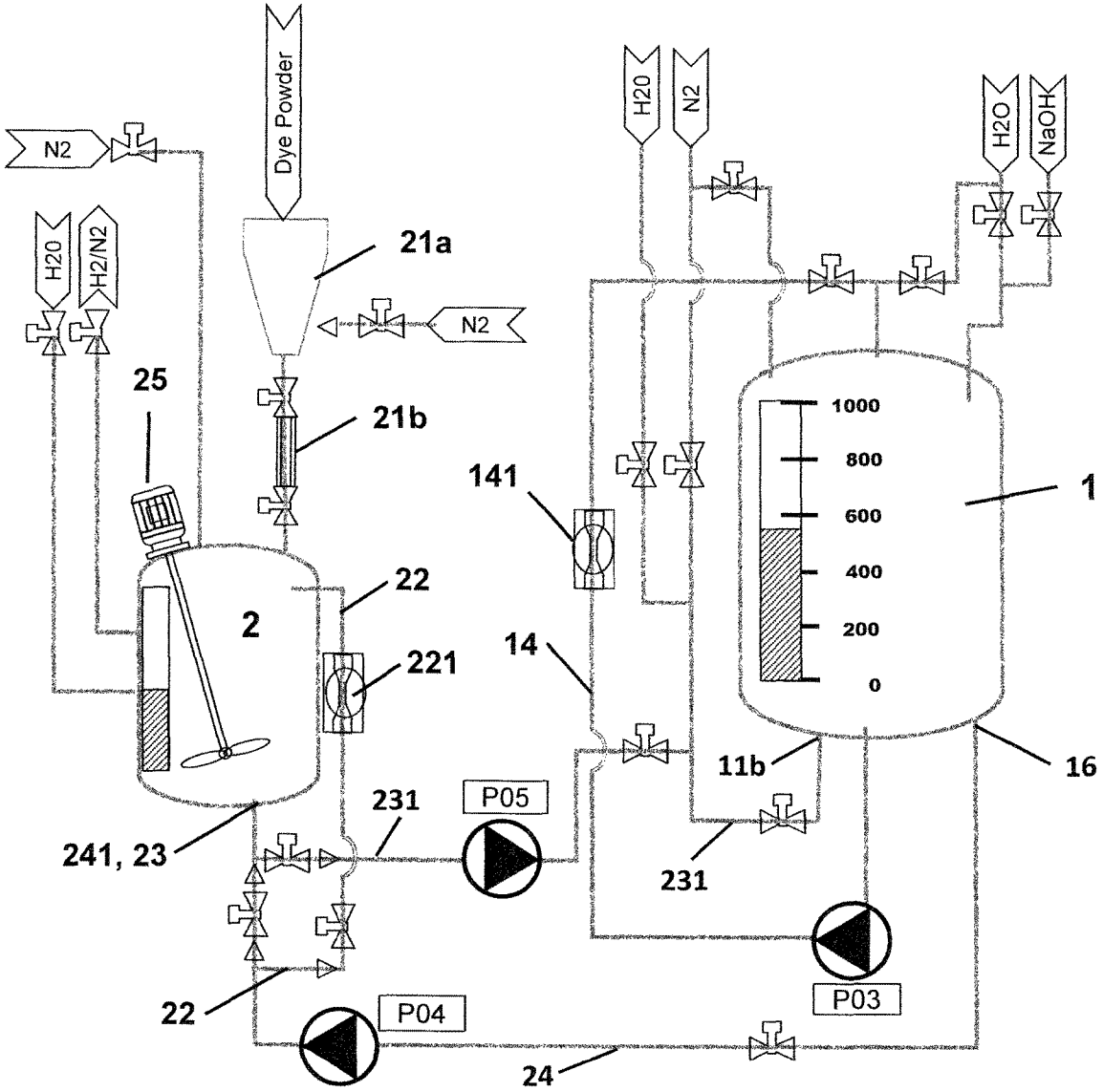
FIG. 6 shows in more detail the part of the electrochemical reactor that serves the catholyte preparation in the presence of a first vessel.

In an alternative catholyte preparation method, shown in FIGS. 5 and 6, the dye suspension is prepared in a first vessel 2. As best shown in FIG. 6, this preparation comprises supplying solid dye from solid dye vessel 21*a* via solid dye inlet 21*b* into a solution of caustic soda with desired concentration in first vessel 2. The first vessel can be provided with a first suspension circulation loop 22, optionally equipped with an ultrasound apparatus 221. Once the dye suspension has reached desired homogeneity it is supplied to the main vessel 1 via suspension outlet 23 and dye suspension inlet 11*b*, driven by pump P05. Once the suspension is in main vessel 1, the procedure is as described with regard to FIG. 4.

Figure 7:
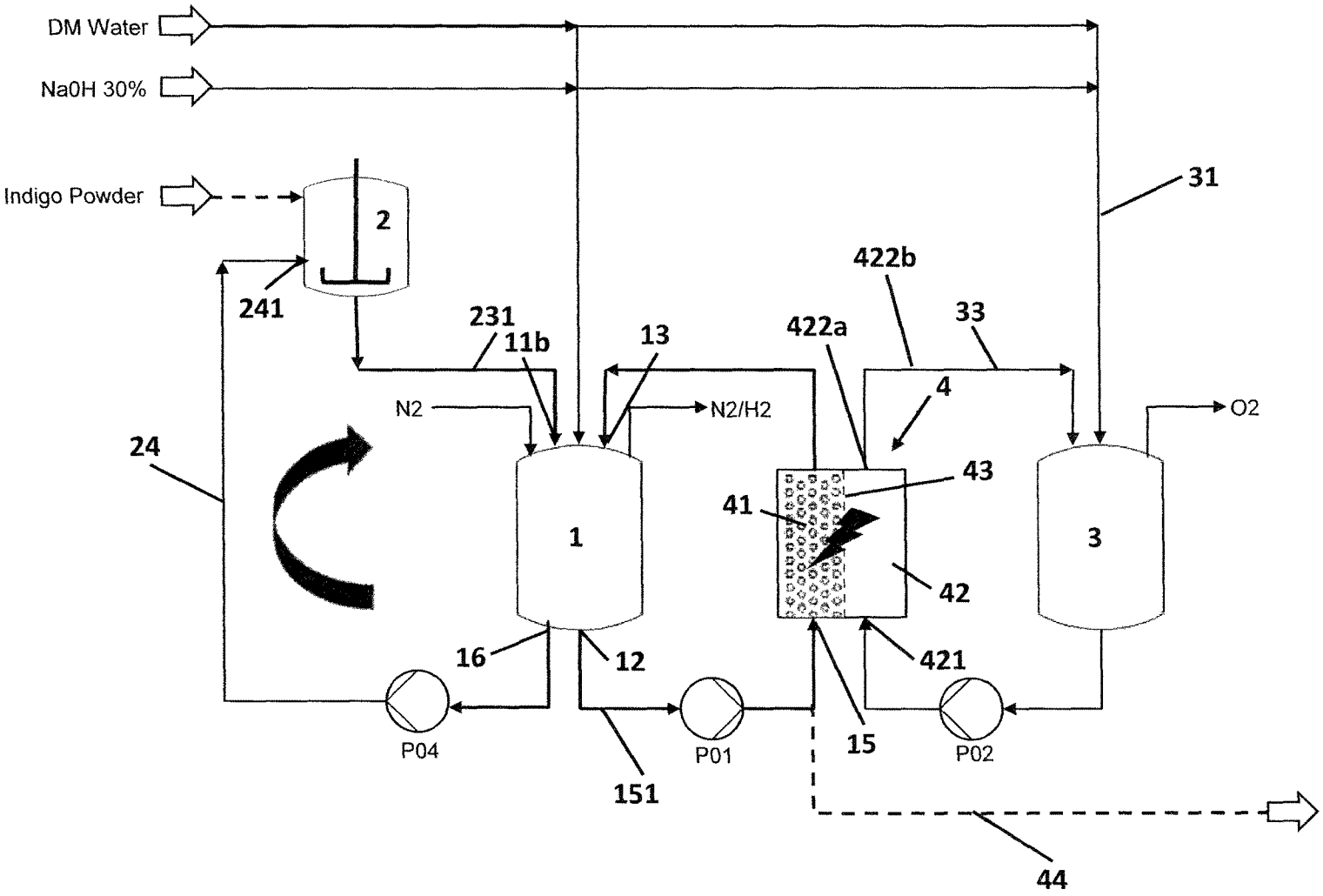
FIG. 7 shows the dye suspension preparation in the presence of a first vessel and with use of internally produced leucodye as dispersing agent.

Most dyes cannot be suspended in the desired high amounts without the addition of substantial amounts of dispersing agent. It has now surprisingly been found that leucodye such as leucoindigo can act as dispersing agent thereby allowing a purer leucodye and thus a purer dying process. A dye reduction method using leucodye as dispersing agent is schematically shown in FIG. 7.

In order to start a dye reduction, in a first preparatory step a diluted suspension is prepared as described above and subjected to electrolytic reduction in electrolytic cell 4. Once the dye has been reduced to leucodye, it can either be supplemented with further dye in the main vessel 1 or—most preferred—some of the leucodye produced can be transferred from the main vessel 1 via leucodye outlet 16, leucodye return pipe 24 equipped with leucodye return pump P04 and leucodye inlet 241 to the first vessel 2 for being supplemented with further dye. The leucodye comprising suspension can then be first processed in the first suspension circulation loop 22 in order to improve its homogeneity before being fed to main vessel 1 and finally to the electrolytic cells as described above.

In a similar way, once the leucodye production has been started, part of the concentrated leucodye is removed and part of the leucodye solution in left in the reactor. This remaining leucodye solution can then be either left in the main vessel 1 or—preferably—fed to first vessel 2 as shown in FIG. 7 via leucodye return pipe 24. In the main vessel 1 or preferably in the first vessel 2 the leucodye solution is diluted with additional electrolyte such as caustic soda. Since the leucodye acts as dispersing agent, a higher concentrated dye suspension can be prepared directly. Nevertheless, it has proved advantageous to add the leucodye in several parts, indicated in the Figures, like FIG. 7, as semicircular arrow. In the case of leucoindigo it has been found that concentrations of 5 to 20% are suitable for stabilizing suspensions comprising indigo in amounts of up to 20%. Once the indigo has been reduced to leucoindogo in the desired concentration, the leucoindigo is removed from the reactor via concentrated leucodye outlet 44.

Figure 8:
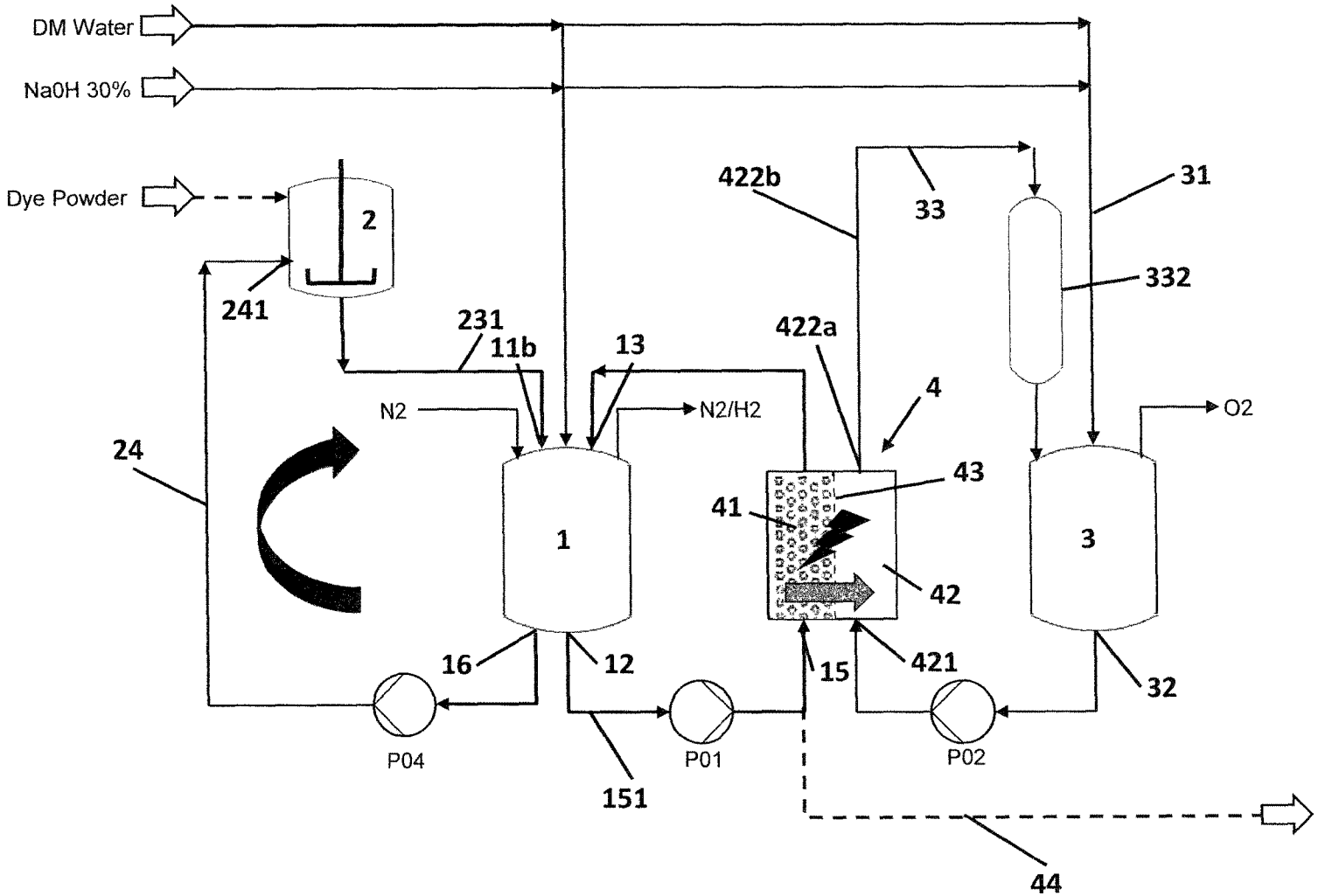
FIG. 8 shows the reactor and method with continuous cleaning of the anolyte with an adsorption filter.

As already indicated above and as shown in FIGS. 3 and 8, an adsorption filter 332 can be provided in the anolyte circulation loop 33. If the anolyte circulation loop 33 comprises a heating means 331, the adsorption filter 332 preferably is provided close to but upstream of the heating means 331 and the heating means 331 is preferably provided upstream of the anode compartment. This adsorption filter serves the removal of small molecules that may be present and in general are present in the dye and have been found to migrate through the separator 43, e.g. a semipermeable membrane, and directly or after reaction like polymerization deposit on the anode thereby affecting its activity.

Suitable adsorption filter materials are e.g. activated carbon and molecular sieves like zeolites. For good anolyte flow through the adsorption filter particle sizes of about 1 to 3 mm, in particular about 2 mm are preferred.

While there are shown and described presently preferred embodiments of the invention, it is to be distinctly understood that the invention is not limited thereto but may be otherwise variously embodied and practiced within the scope of the following claims.

LIST OF REFERENCE NUMBERS

1 main vessel
11*a* solid dye inlet
11*b* dye suspension inlet
12 catholyte outlet
13 reduced catholyte inlet
14 main suspension circulation loop
P03 main suspension circulation pump
141 ultrasound apparatus in main suspension circulation loop
15 catholyte circulation pipe or catholyte circulation loop
151 catholyte supply pipe
P01 catholyte supply pump
152 particle filter in catholyte supply pipe
153 catholyte heating means (heat exchanger)
154 ultrasound apparatus in catholyte supply pipe
16 leucodye outlet
2 first vessel
21*a* solid dye vessel
21*b* solid dye inlet
22 first suspension circulation loop
221 ultrasound apparatus in first suspension circulation loop
23 first suspension outlet
231 first suspension supply pipe
P05 first suspension supply pump
24 leucodye return pipe
241 leucodye inlet
25 first suspension mixer
P04 leucodye return pump
3 anolyte vessel
31 anolyte supply pipe
32 anolyte outlet
33 anolyte circulation pipe or anolyte circulation loop
331 anolyte heating means such as heat exchanger
332 adsorption filter
P02 anolyte pump
35 anolyte inlet
4 electrolytic cell with
41 cathode compartment
411 catholyte inlet
412*a* reduced catholyte outlet
412*b* reduced catholyte return pipe
413*a* bypass for changing catholyte direction
413*b* bypass for changing catholyte direction
42 anode compartment
421 anolyte inlet
422*a* anolyte outlet
422*b* anolyte return pipe
43 separator, semipermeable membrane
44 concentrated leucodye outlet (batchwise)
5 stack of electrolytic cells
61 cleaning medium supply pipe
62 cleaning medium removal pipe
63*a* acid vessel
63*b* base vessel
64 cleaning medium circulation means

The invention claimed is:

1. An electrochemical reactor, suitable for reducing a dye suspension to its leucodye solution, comprises at least four electrolytic cells, wherein the at least four electrolytic cells are provided in the form of at least two stacks of at least two electrolytic cells, said stacks are connected in parallel and allow the separation of at least one of the at least two stacks at a time for washing/regeneration of a cathode during a preparation of the dye suspension while catholyte solution is circulated through at least one of the at least two stacks, wherein the electrolytic cells of each stack are connected in parallel and wherein the electrolytic cells comprise a cathode compartment and an anode compartment separated by a separator, the separator comprising a semipermeable membrane, said cathode compartment comprises a multitude of freely suspended conductive, non-spherical granules in contact with a conductor forming at least the side wall opposite to the separator, said cathode compartment is provided with an upper grid and a lower grid, the width of the mesh and the positioning of said grids are chosen such that the liquid catholyte can pass through the upper grid and the lower grid but the granules are prevented from passing through the upper grid and the lower grid so that they are retained in the cathode compartment, wherein the anode compartment has a wall opposite to the separator, wherein said cathode compartment is connected to a main vessel via a catholyte supply pipe and a reduced catholyte return pipe for circulating catholyte through the cathode compartment, and said anode compartment is connected to an anolyte vessel via an anolyte supply pipe and an anolyte return pipe, wherein said cathode compartment and said anode compartment are also provided with means for supplying acidic cleaning solutions and water and optionally basic solution to the cathode compartment and the anode compartment, said means comprise at least one cleaning medium supply pipe and at least one cleaning medium removal pipe at opposite ends of the cathode compartment and of the anode compartment for supplying and removing acidic cleaning solutions and water and optionally also a basic solution, said cleaning medium supply pipes and said cleaning medium removal pipes being either bypasses of the catholyte supply pipe and/or the anolyte supply pipe and/or the reduced catholyte return pipe and/or the anolyte return pipe, or independent pipes with own inlets and outlets adjacent to the ones of the catholyte supply pipe and the reduced catholyte return pipe, or the anolyte supply pipe and the anolyte return pipe, said at least one cleaning medium supply pipe is connected to at least one vessel for supplying acid and optionally base and is also connected to a water line supplying deionized water, and the at least one cleaning medium removal pipe is connected to a waste water treatment plant (WWTP) or to a waste water vessel.

2. The electrochemical reactor of claim 1, wherein the at least two stacks comprise at least 6 stacks and each stack comprising from 2 to 10 electrolytic cells, the at least 6 stacks being connected such that at any time at least one of the at least 6 stacks are separatable for being supplied with cleaning medium or water while the remaining stacks are connected such that the catholyte solution comprised in the stacks and the connecting pipes are circulatable through the remaining stacks.

3. The electrochemical reactor of claim 1 comprising a first vessel upstream of the main vessel.

4. The electrochemical reactor of claim 1, further comprising circulation means allowing the acidic cleaning solutions and optionally the basic solution to be circulated via the cathode compartment and/or the anode compartment prior to being removed.

5. The electrochemical reactor of claim 1, wherein the cleaning medium supply pipes are connected with the catholyte supply pipes and/or the anolyte supply pipes feeding each stack.

6. The electrochemical reactor of claim 1, wherein the anode compartments of each stack are connected with the cleaning medium and water supply pipes such that the anode compartments are configured to be individually controlled and washed simultaneously with or independently from the cathodes of the respective stack.

7. The electrochemical reactor of claim 1, wherein at least catholyte direction is invertible.

8. The electrochemical reactor of claim 1 wherein the anode compartment of each of the electrolytic cells is placed in an anolyte circulation loop, said anolyte circulation loop being provided with an adsorption filter for removing molecular impurities.

9. The electrochemical reactor of claim 1, wherein the main vessel is for preparing a catholyte to be reduced by circulating a main suspension through a main suspension circulation loop equipped with a main suspension circulation pump and optionally an ultrasound apparatus and optionally a heating means, for raising the temperature to about 50° C. to 65° C.

10. The electrochemical reactor of claim 1, wherein the main vessel is for preparing a catholyte by circulating the catholyte through a catholyte circulation loop containing the catholyte supply pipe equipped with a catholyte supply pump and optionally at least one of an ultrasound apparatus, a particle filter for removing particles of >50 to 100 μm and a catholyte heating means for raising the temperature to about 50° C. to 65° C., the cathode compartment and the reduced catholyte return pipe for returning a catholyte reduced in the cathode department via a reduced catholyte inlet into the main vessel.

11. The electrochemical reactor of claim 3, wherein the first vessel comprises a first suspension circulation loop equipped with a first suspension circulation pump and an ultrasound apparatus.

12. The electrochemical reactor of claim 1, comprising a first vessel, wherein the first vessel and/or the main vessel used for catholyte preparation are/is connected with the cathode compartments of the electrolytic cells of each stack such that the first and/or main vessel are configured to be supplied with water through each one of the stacks independently.

13. The electrochemical reactor of claim 4, wherein said circulation means comprises at least one particle filter and/or at least one adsorption filter.

* * * * *